US005416975A

United States Patent [19]

Saito et al.

[11] Patent Number: 5,416,975

[45] Date of Patent: May 23, 1995

[54] HYDRAULIC PUNCHER

[75] Inventors: Masayuki Saito; Masunari Kowada, both of Tokyo, Japan

[73] Assignee: Nitto Kohki Co., Ltd., Tokyo, Japan

[21] Appl. No.: 158,451

[22] Filed: Nov. 29, 1993

[30] Foreign Application Priority Data

Dec. 3, 1992 [JP] Japan ..... 4-089595 U

[51] Int. Cl.[6] ..... B26F 1/00

[52] U.S. Cl. ..... 30/362; 30/228

[58] Field of Search ..... 30/180, 210, 228, 358, 30/362; 83/686, 916

[56] References Cited

U.S. PATENT DOCUMENTS 3,924,330 12/1975 Mitsuhashi et al. ..... 30/362
3,988,829 11/1976 Sumida ..... 83/916 X
4,136,445 1/1979 Grubb ..... 30/228 X
5,095,618 3/1992 Daley ..... 30/362
5,233,749 10/1993 Saito et al. ..... 30/362

*Primary Examiner*—Douglas D. Watts
*Attorney, Agent, or Firm*—Nixon & Vanderhye

[57] ABSTRACT

A hydraulic puncher comprises a generally C-shaped frame member having a pair of opposed ends between which a workpiece is disposed, and a hydraulic actuator fixedly connected to one end of the frame member. Provided on one end of the frame member is a ram having a punch fixed to the front end of the ram and reciprocated by an actuator. The other end of the frame member supports a die cooperating with the punch via a removable die mount. The die mount has a groove open toward the interior of the C-shaped frame, for receiving a part of a workpiece.

3 Claims, 2 Drawing Sheets

HYDRAULIC PUNCHER

BACKGROUND OF THE INVENTION

1. Field of the Invention

This invention relates to a hydraulic puncher suitably used for punching holes in a C-shaped shape steel member.

2. Description of the Related Art

As shown in FIG. 3, the conventional hydraulic puncher 50 for punching holes in a C-shaped shape steel member has a die mount 53 fixed to the upper surface of the front end of the lower frame 51 of a puncher body 2. The die mount 53 has such a width as is allowed to pass through an opening 23 defined between tongue portions 24 formed on both lower lateral side ends of the flat portion 22 of a workpiece 21. When the die mount 53 is removed, the front portion of the lower frame 51 exhibits a large opening 58. Since the workpiece 21 has arm portions 25 extending by a length M between the flat portion 22 and the tongue portions 24, the die mount 53 on which a die 55 is mounted must be fixed to the upper surface of the front end of the lower frame 51 upon using the hydraulic puncher 50.

On the conventional hydraulic puncher 50, therefore, holes can be punch-formed in the central portion of the workpiece 21 which is placed on the upper surface of the die 55 by moving the die mount 53 along the workpiece 21 in its opening 23. Because the tongue portions 24 which are formed parallel with the flat portion 22 and project inwardly, the forward ends of the tongue portions 24 abut against the lateral sides of the die mount 53 when the workpiece 21 is moved rightward or leftward in FIG. 3. Thus, the lateral sides 25 of the workpiece 21 cannot approach the die mount 53 beyond a predetermined distance. Therefore, the conventional hydraulic puncher 50 has a problem that holes cannot be formed in those portions of the flat portion 22 of a workpiece which are close to its arms 25.

This invention was made to overcome the problem of the conventional hydraulic puncher, and the object thereof is to provide a hydraulic puncher in which an escaping groove for receiving one of the tongue portions of a workpiece so as to increase the rightward and leftward movement of a workpiece like a C-shaped shape steel member is formed in that lateral side of a die mount fixed to the upper surface of the front end of the lower frame of the hydraulic puncher which is at the side of the lower frame, such that holes are punch-formed in any parts of the flat portion of the workpiece.

This invention provides a hydraulic puncher which comprises a generally C-shaped frame member having a pair of opposed ends, a connecting portion for connecting the opposed ends together, and an opening defined between the opposed ends, for receiving a part of a workpiece, a hydraulically driving mechanism connected to one of the opposed ends of the frame member, a ram provided on the front end thereof with a punch and driven by the driving mechanism, a die supported by the other end of the frame member and cooperating with the punch, and a die mount removably mounted on the other end of the frame member for fixedly holding the die, the die mount being provided in a side thereof opening toward the connecting portion with a groove for being capable of receiving a part of the workpiece.

Since an escaping groove for receiving a tongue of a workpiece like a C-shaped shape steel member is formed in that side of the die mount fixed to the upper surface of the front end of the lower frame which is at the side of the lower frame, each lateral side of the workpiece is made to approach the die mount much more than in the case of the conventional hydraulic puncher by moving the workpiece back and forth with respect to the lower frame, whereby holes can be punch-formed in the portions of the flat portion of the workpiece which are close to the right and left sides of the workpiece. According to this invention, therefore, a variety of holes can be formed in a workpiece with much improved punching operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of this invention will be described with reference to the drawings.

Figure 1:
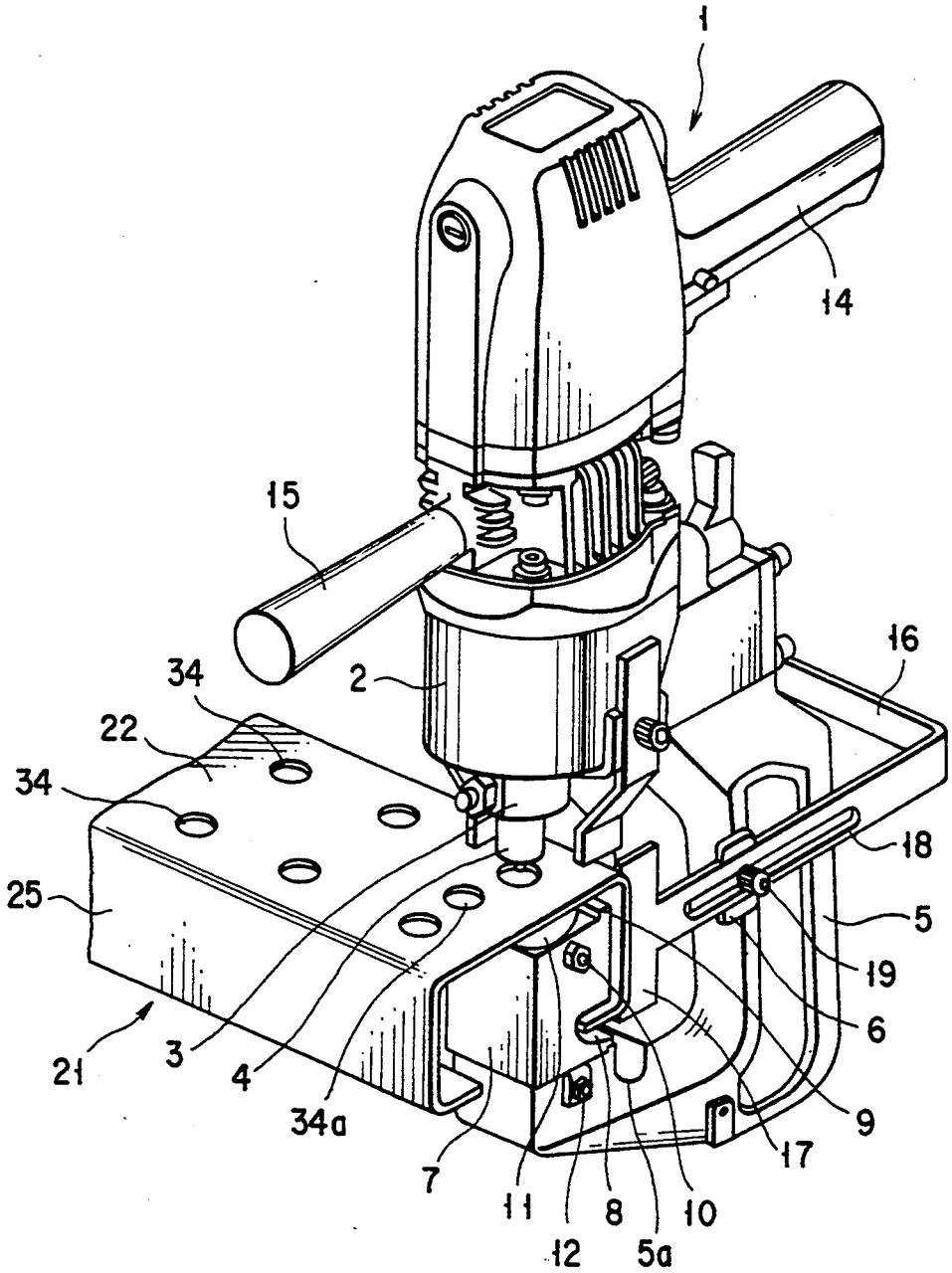
FIG. 1 is a perspective view of a hydraulic puncher according to one embodiment of this invention, which is in an operating state.
Figure 2:
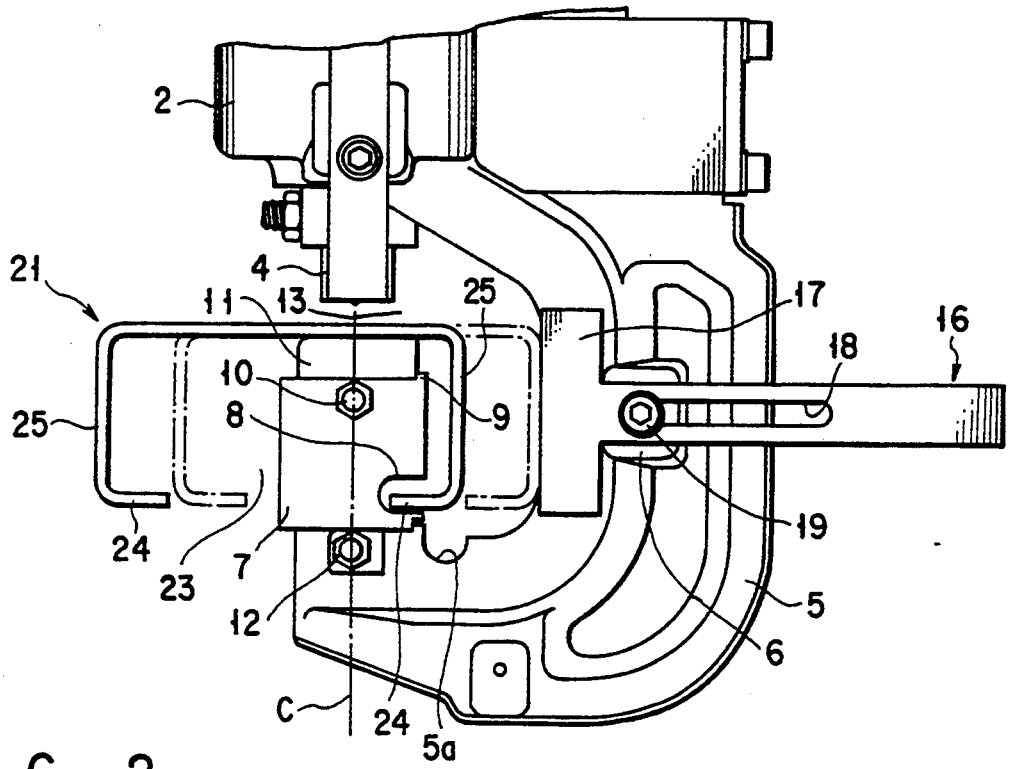
FIG. 2 is a side view of the hydraulic puncher on which a workpiece is moved leftward horizontally.
Figure 3:
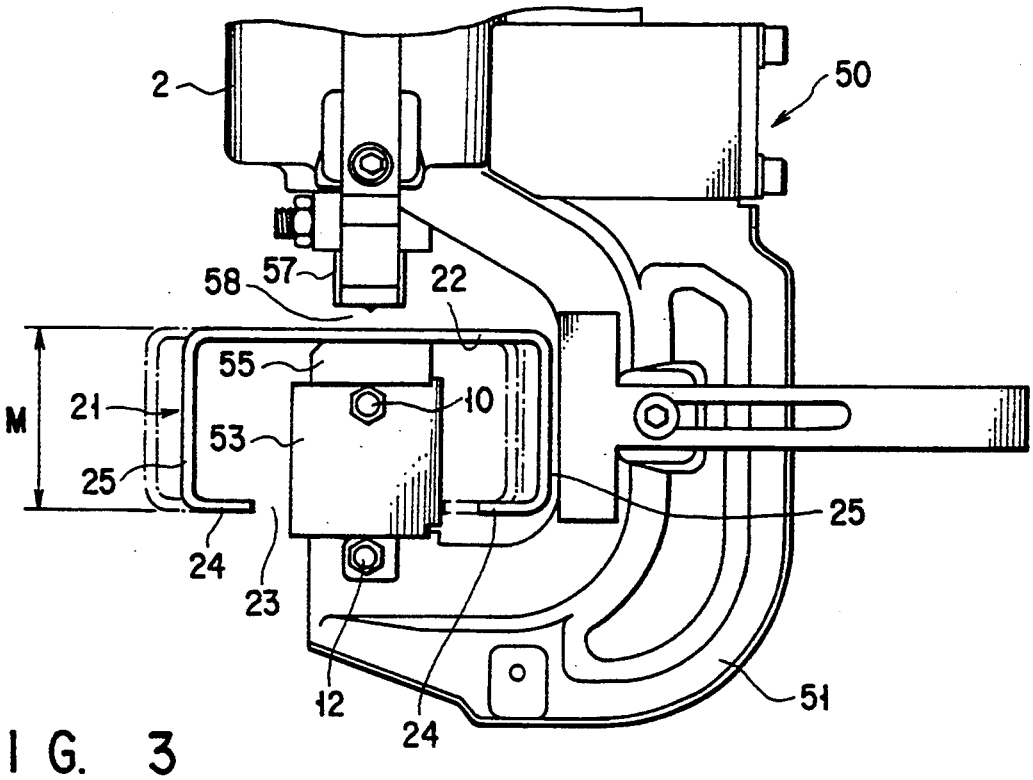
FIG. 3 is a side view of a hydraulic puncher which is going to start its operation by using a conventional die mount.

As shown in FIGS. 1 and 2, a piston which is lifted and lowered by a hydraulic pressure is housed in a cylinder provided in a puncher body 2 constituting a part of a hydraulic puncher 1. A punch 4 is removably provided on the lower end of a ram shaft 3 cooperating with the piston. Integrally formed on the lower portion of the puncher body 2 is a generally C-shaped lower frame 5 provided at its front portion with an opening 13. A die mount 7 for adjusting a height is detachably connected to the upper surface of the front end of the lower frame 5 by means of a bolt 12. A escaping groove portion 8 is formed in that side surface of the die mount 7. In the illustrated embodiment, the escaping groove portion 8 has an inlet opening which faces the lower frame 5 and a rounded bottom surface. The escaping groove portion 8 may have a U-shaped, key-shaped or the like cross sectional configuration. A stop portion 9 is formed on one side of the upper surface of the die mount 7. The escaping groove portion 8 extends from the side surface of the die mount 7 to a portion just in front of the central line C of the die mount 7 such that the die mount 7 is not broken by the pressing force of the hydraulic puncher. A generally C-shaped escaping groove portion 5*a* is formed in that portion of the die mount 7 of the lower frame 5 which is at the vicinity of the fixing portion. 11 designates a die fixed to the upper surface of the die mount 7 and is used with the punch 4, for forming holes in the workpiece. The die 11 is made to contact with the stop portion 9 and fixed to the die mount 7 by means of a tightening bolt 10. A punching hole (not shown) in which the punch 4 is fitted is formed in the central portion of the upper surface of the die 11.

16 shows a generally U-shaped guide gage which is fitted in engaging groove portions 6 formed in both sides of the lower frame 5 of the hydraulic puncher 1 so as to reciprocate. An upward and downward extending guide piece 17 is formed on each of the front ends of the guide gage 16. The guide gage 16 is fixed at its front ends to the lower frame 5 by tightening fastening bolts 19 passing through guide grooves 18 formed in the front portions of the guide gage 16. 21 depicts an elongated workpiece made from a channel-shaped steel member having a generally C cross section or the like. The workpiece 21 has a flat upper portion 22 (hereinafter referred to as the "flat portion") in which holes are to be formed, lateral sides 25 bent downward from both sides of the flat portion 22, tongue portions 24 bent inwardly from the lower edges of the lateral side portions 25 so as to extend in parallel with the flat portion 22, and an opening 23 defined between the tongue portions 24. 14 indicates a main handle provided on the upper rear end of the hydraulic puncher 1, and 15 shows an auxiliary handle provided on the opposite side of the hydraulic puncher 1 to the side of the main spindle 14.

The operation of this embodiment is as follows.

It will be explained how to punch holes in portions of a workpiece which are adjacent to a lateral side 25 of the flat portion 22. As shown in FIGS. 1 and 2, the die mount 7 is inserted in the workpiece 21 through the opening 23 from the side of the hydraulic puncher 1. The workpiece 21 is placed such that the flat portion 22 of the workpiece 21 is positioned in parallel with the flat surface of the die 11. Then, a hole is punched in a portion of the flat portion 22 which is close to the lateral side 25. In this case, when the workpiece 21 is moved in the right or left direction or in the back and forth directions of the hydraulic puncher 1, the corresponding tongue portion 24 of the workpiece 21 enters the escaping groove 8. Thus, the lateral side 25 can be made to approach the die mount 7 much more than in the case of the conventional hydraulic puncher, and through holes 34 can be punch-formed in the portions of the flat portion 22 which are closer to the lateral sides of the workpiece 21.

In order to position the workpiece 21 on the die 11, the fastening bolts 19 are loosened first and the guide gage 16 is reciprocated to adjust the amount of projection of the guide piece 17 such that the die 11 is on a line on which the portions of the workpiece 21 which holes are to be punched lie, and the fastening bolts 19 are tightened again. Thereafter, the workpiece 21 is moved rightward or leftward such that a portion of the workpiece 21 which is close to the lateral side 25 of the workpiece 21 and is to be formed with a hole is disposed on the die 11. Then, the hole is punched in the required portion of the workpiece 21. When holes are formed in the portions of the workpiece 21 which are opposite to the previously holed portions of the workpiece 21, the workpiece 21 is pulled off the die mount 7 and is turned vertically for 180°. The workpiece 21 is mounted on the die mount 7 in the same way as the way in which the first adjacent portions of the workpiece 21 have been holed by adjusting the back and forth movement of the guide pieces 17 and rightward or leftward movement of the workpiece 21. In this way, holes can be formed in any portions of the flat portion 22 of the workpiece 21.

Holes are formed in the lateral sides 25 of the workpiece 21 in the following ways. The fastening bolt 12 is loosened and the die mount 7 is removed. Then, the die 11 is fixed to the upper surface of the front portion of the lower frame 5. The lateral side 25 to be formed with holes is placed on the upper surface of the die 11 and a hole is punch-formed in the required portion of the lateral side 25. Since the corresponding tongue portion 24 of the workpiece 21 can be made to engage with the U-shaped, for example, escaping groove portion 5*a*, the lateral side 25 can be in close contact with the upper surface of the die 11.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A hydraulic puncher comprising:

a generally C-shaped frame member having a pair of opposed ends, a connecting portion for connecting said opposed ends together, and an opening defined between said opposed ends, for receiving a workpiece;

a hydraulic driving mechanism connected to one of said opposed ends of said frame member;

a ram provided on said one end of said frame member, reciprocated by said hydraulic driving mechanism and having a front end provided with a punch;

a die supported by the other end of said frame member and cooperating with the punch; and a die mount removably mounted on the other end of said frame member, for fixedly holding said die, with said die between said die mount and said other end of said frame member;

said die mount being provided in a side thereof opening toward the connecting portion with a groove for receiving a part of said workpiece, said groove being defined by two mutually facing generally parallel side walls and a bottom wall;

said groove extending coextensively with said die mount and in a direction substantially perpendicular to a plane including said C-shaped frame, said puncher being useful for punching a workpiece having a pair of mutually facing, lateral sides, a flat portion joining the lateral sides and a pair of tongue portions extending from the lateral sides in a direction toward each other such that the workpiece tongue portions may be received in the groove to enable punching operations in said flat portion adjacent the lateral sides.

2. A hydraulic puncher comprising:

a generally C-shaped frame member having a pair of opposed ends, a connecting portion for connecting said opposed ends together, and an opening defined between said opposed ends, for receiving a workpiece;.

a hydraulic driving mechanism connected to one of said opposed ends of said frame member;

a ram provided on said one end of said frame member, reciprocated by said hydraulic driving mechanism and having a front end provided with a punch;

a die supported by the other end of said frame member and cooperating with the punch;

a die mount removably mounted on the other end of said frame member, for fixedly holding said die, said die mount being provided in a side thereof opening toward the connecting portion with a groove for receiving a part of said workpiece; and a guide gage for positioning said workpiece mounted on said die, said guide gage including a connecting portion, a pair of arm portions connected by said connecting portion of said guide gage, fixing means for securing said arm portions to said connecting portion, guiding pieces connected to front ends of the respective arm portions and capable of abutting against the respective guide pieces, and adjusting means for adjusting a position of each of said guide pieces.

3. The hydraulic puncher according to claim 2, wherein said fixing means comprises fastening bolts, and said adjusting means has guide grooves which extend lengthwise of said arm portions and through which said fastening bolts pass.

* * * * *